US005239151A

United States Patent [19]

King et al.

[11] Patent Number: 5,239,151

[45] Date of Patent: Aug. 24, 1993

[54] LEAF SWITCH

[75] Inventors: Albert King, Rietheim-Weilheim; Guenther Marquardt, Aldingen, both of Fed. Rep. of Germany

[73] Assignee: Marquardt GmbH, Rietheim-Weilheim, Fed. Rep. of Germany

[21] Appl. No.: 791,178

[22] Filed: Nov. 13, 1991

[30] Foreign Application Priority Data

Nov. 14, 1990 [DE] Fed. Rep. of Germany ..... 4036236

[51] Int. Cl.[5] ..... H01H 5/10

[52] U.S. Cl. ..... 200/458; 200/405; 200/453; 200/459; 200/460; 200/467

[58] Field of Search ..... 200/405, 451, 452, 453, 200/454, 458, 459, 460, 465, 466, 467

[56] References Cited

U.S. PATENT DOCUMENTS 2,260,964 10/1941 Wilms .
3,291,931 12/1966 Rogers ..... 200/451
3,322,915 5/1967 Johnson .
3,336,449 8/1967 Ashman ..... 200/452
3,662,132 5/1972 Good ..... 200/454

FOREIGN PATENT DOCUMENTS 2005018 8/1971 Fed. Rep. of Germany .
2356989 5/1975 Fed. Rep. of Germany .
3208990 9/1983 Fed. Rep. of Germany .
3308188 9/1984 Fed. Rep. of Germany .

*Primary Examiner*—Allan N. Shoap
*Assistant Examiner*—Paul A. Schwarz
*Attorney, Agent, or Firm*—Spencer, Frank & Schneider

[57] ABSTRACT

The invention relates to a leaf switch having a scroll spring (6) which can be hooked between a switching are elongate windows which extend in the transverse direction and into which centrally projecting tongues (3*a*, 2*a*) of the switching tongue (3) and of the spring lever (2) engage. In order to avoid an unintentional unhooking of the scroll spring (6), there is a deformation projecting beyond the tongue surface at the front section of at least one of the two tongues (3*a*, 2*a*). The said deformation can be constructed as an embossed hollow projection or as laterally bent-over tongue legs.

5 Claims, 2 Drawing Sheets

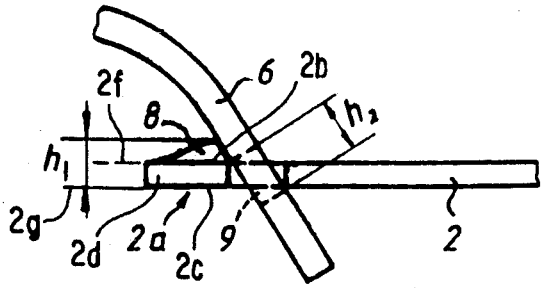
Fig.2
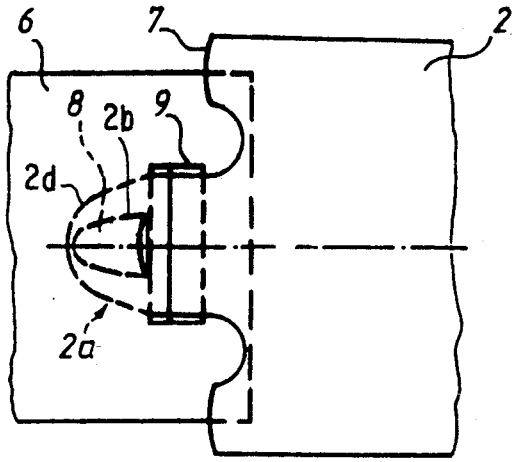
Fig.3
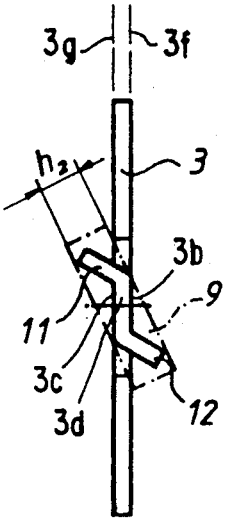
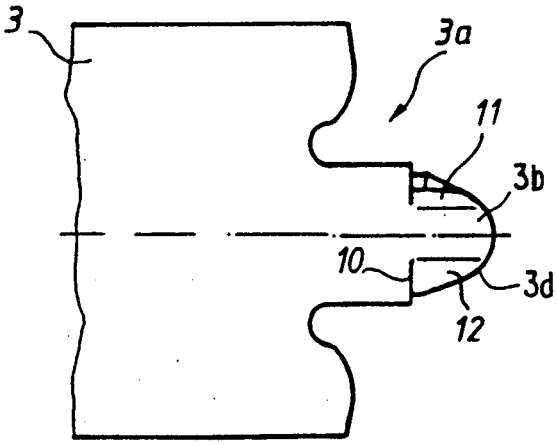
Fig.5
Fig.4

LEAF SWITCH

BACKGROUND OF THE INVENTION

The invention relates to a leaf switch having a scroll spring which can be hooked between a switching tongue and a spring lever. The scroll spring is provided at both ends with elongate windows which extend in the transverse direction. Centrally projecting tongues are provided at the free opposite ends of the switching tongue and the spring lever. The tongues extend into the windows.

In the known commercially available leaf switches of this kind, the scroll spring is normally secured in the projections at the ends of the switching tongue and of the spring lever by means of their pretensioning. However, it may occasionally occur that the scroll spring jumps out in the event of shocks or similar influences of one of these projections designated below as tongues.

In order to prevent this it is already known to use particularly long strip-shaped tongues and to bend over their ends around one transverse edge in each case and, to be precise, to bend the tongue of the spring lever towards the center of the scroll spring and the tongue of the switching tongue away from this center. The bending over occurs after the installation of the scroll spring and requires complicated devices.

However, this subsequently applied unhooking protection by bending over the tongues is inconvenient for the automized mounting of small leaf switches.

SUMMARY OF THE INVENTION

The invention is based on the object of providing a scroll spring protection which is suitable for an automatic mounting and offers a secure protection against unintentional unhooking.

According to the invention, this is achieved in a leaf switch of the type designated at the beginning in that a deformation projecting beyond the tongue surface is made at the front section of at least one of the two tongues. Expedient types of embodiment of this embossed deformation are, for example, a hollow embossed projection projecting on one side or a kind of agitator vane consisting of two parts which are bent over on opposite sides, these being separated by transverse incisions of the side edges of the front tongue section. It is essential that the respective deformation has a transversely running edge on which the scroll spring rests and thus can no longer jump back over the deformation even in the event of shocks.

The advantage for the production of the leaf switch consists in the fact that the proposed deformations can already be made during the manufacture of the spring lever and of the switching tongue, i.e. in the corresponding punching and bending machines. The mounting of the scroll spring then occurs essentially as before. The window cut-outs in the scroll spring on the one hand and the deformed front tongue sections of the switching tongue and of the spring lever on the other are dimensioned in cross section or matched to one another in such a way that the scroll spring can be fastened with its windows over the deformed front tongue sections. This process can be made easier by the deformation having a contour which drops away towards the tongue tip.

Various deformation variants can also be combined in a switch in that the switching tongue is given a different deformation than the spring lever or only one tongue of these two components is deformed. In addition, it may be advantageous to select the deformation cross section in such a way that the insertion is only possible if the tongue is twisted a little about the tongue longitudinal axis with respect to the window. The scroll spring and the other respective component must therefore become slightly elastically deformed for the purpose of insertion. This gives rise to an additional protection.

BRIEF DESCRIPTION OF THE DRAWING

FIG. 2 is a side elevational view of the spring lever end inserted into the scroll spring in a relatively large scale.

FIG. 3 is a top plan view of the arrangement according to FIG. 2.

FIG. 4 is a top plan view of the switching tongue end.

FIG. 5 is a front elevational view of the switching tongue end.

DESCRIPTION OF THE PREFERRED EMBODIMENT

Figure 1:
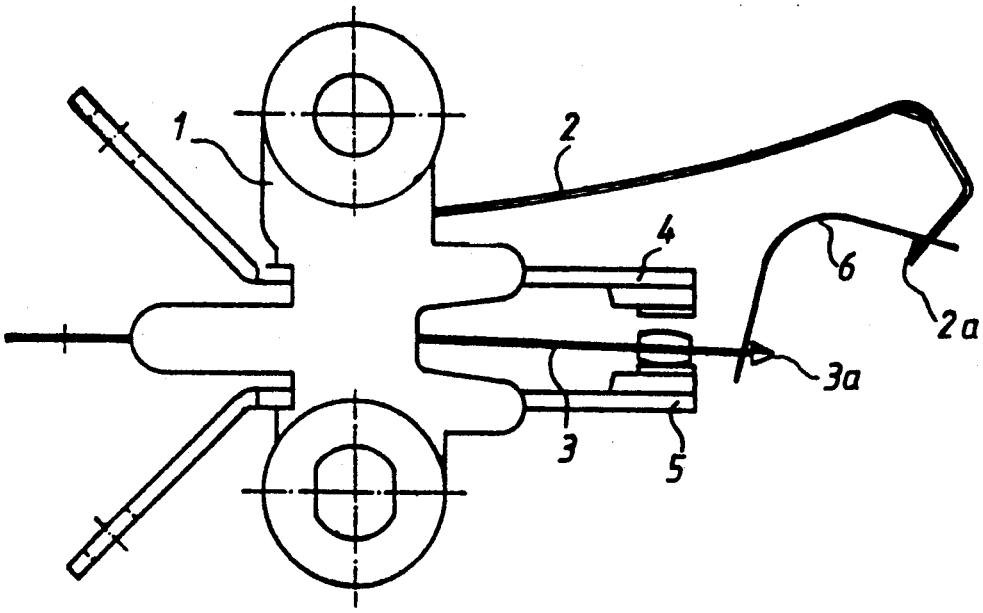
FIG. 1 is a side elevational view of the leaf switch

The leaf switch illustrated in FIG. 1 is constructed as a selective switch. A spring lever 2, a switching tongue 3 and two contact springs 4 and 5 are embedded in a console 1. The connection ends of the three spring elements last mentioned are constructed as solder tags. A scroll spring 6 is clamped into the tongues 2*a* and 3*a* of the spring lever or the switching tongue.

The connection point between the scroll spring 6 and the spring lever 2 is shown in greater detail in FIGS. 2 and 3. The free end of the spring lever 2 which is bent over twice has two support shoulders 7 and in the center a protruding tongue 2*a* which ends in a rounded-off tip. The tongue 2*a* is a flat member: it has opposite large faces 2*b*, 2*c* and a small edge face 2*d*. The large faces 2*b*, 2*c* lie in a plane 2*f*, 2*g*, respectively. In the front section of the tongue 2*a* an upwardly protruding projection (deformation) 8 which drops away at the front and becomes narrower is embossed. The height of the projection including the thickness of the spring lever 2 is designated by $h_1$. Thus, the projection 8 rises from the large face 2*b*, projecting beyond the plane 2*f* in which the large face 2*b* lies. The scroll spring 6 has two right-angled windows 9, which extend in the transverse direction and whose height $h_2$ is dimensioned in such a way that the tongue 2*a* can be pushed through easily but without much clearance. After the joining, as illustrated, the one transverse edge of the window 9 comes to rest behind the projection 8 whilst the support shoulders 7 come to rest next to the window 9 on the surface of the scroll spring 6 which is under tension.

The free end of the switching tongue 3 with its tongue 3*a* can be seen from FIGS. 4 and 5. The tongue 3*a* is a flat member: it has opposite large faces 3*b*, 3*c* and a small edge face 3*d*. The large faces 3*b*, 3*c* lie in a plane 3*f*, 3*g*, respectively. In the side edges of the tongue 3*a* there are two incision 10 in the transverse direction, by which means approximately triangular legs 11 and 12 are partially separated. These legs 11 and 12 are bent through approximately 60° about their longitudinal edges towards opposite sides along opposite side portions of the edge face 3*d*, as shown best in FIG. 5. Thus, the legs 11, 12 project beyond the planes 3*f*, 3*g* in which the respective large faces 3*b*, 3*c* lie. In FIG. 5 one of the windows 9 of scroll spring 6 is additionally indicated in a plan view by dot-dashed lines, from which it can be seen that with this deformation the tongue 3*a* can only be pushed obliquely through the window 9.

In order to complete the console 1 mounted with the individual spring elements by means of the scroll spring 6 to form the operative switch, the scroll spring 6 is grasped by an automatic mounting machine and inserted into the tongues of the spring lever 2 and of the switching tongue 3. At the same time, the gripping pincers (not illustrated) twist the scroll spring 6 in such a way that the respective window 9 slides over the bent-over legs 11 and 12, in which case the switching tongue 3 can also twist slightly elastically since the rounded tip of the tongue 3*a* projects into the window. The scroll spring 6 which is this way is now protected against vibrations and shock stresses and against slipping out from the tongues 2*a* and 3*a*.

We claim:

1. In a leaf switch including a spring lever having a free end and a central tongue projecting from said free end; said central tongue having opposite large faces and a small edge face; said opposite large faces lying in respective planes;

a switching tongue having a free end and a central tongue projecting from said free end of said switching tongue; said central tongue of said switching tongue having opposite large faces and a small edge face; said opposite large faces of said central tongue of said switching tongue lying in respective planes; and a scroll spring having opposite ends and a window provided at each said end of the scroll spring; said central tongue of the spring lever and said central tongue of the switching tongue extending into each respective window of said scroll spring, and said scroll spring being held in a stressed state by said spring lever and said switching tongue;

the improvement comprising a deformation rising from at least one of the large faces of at least one of the central tongues; said deformation projecting out of the plane of the large face from which the deformation rises.

2. The leaf switch as defined in claim 1, wherein the deformation comprises a hollow projection embossed in one of the tongues; said hollow projection tapering toward a tip of said one tongue.

3. The leaf switch as defined in claim 1, wherein the small edge face of one of said tongue has opposite side portions; further wherein said one tongue comprises two legs formed by respective incisions extending into said one tongue from said side portions; said legs being out of said planes along said side portions into opposite directions to extend away from said one tongue in opposite directions; said legs forming said deformation.

4. The leaf switch as defined in claim 1, wherein said one central tongue is dimensioned in cross section such as to be insertable into one of said windows.

5. The leaf switch as defined in claim 1, wherein said deformation has a contour diminishing toward a tip of said one tongue.

* * * * *